United States Patent [19]

Masuda

[11] 4,291,398

[45] Sep. 22, 1981

[54] CALENDAR DISPLAY WHEEL GUARD CONSTRUCTION OF TIMEPIECE

[75] Inventor: Shigeyuki Masuda, Tokyo, Japan

[73] Assignee: Kabushiki Kaisha Daini Seikosha, Tokyo, Japan

[21] Appl. No.: 55,280

[22] Filed: Jul. 6, 1979

[30] Foreign Application Priority Data

Jul. 25, 1978 [JP] Japan ..... 53-90833

[51] Int. Cl.[3] ..... G04B 19/24; G04B 19/04

[52] U.S. Cl. ..... 368/37; 368/228

[58] Field of Search ..... 58/5, 58, 59, 104, 125 B, 58/126 A, 138, 139, 140 A, 140 R; 368/28, 31, 35, 37, 223, 220, 221, 233, 236

[56] References Cited

U.S. PATENT DOCUMENTS

| | | | |
|---|---|---|---|
| 3,732,687 | 5/1973 | Miyasaka et al. | 58/58 |
| 3,916,614 | 11/1975 | Takatsuki | 58/139 |
| 4,183,204 | 1/1980 | Sauter | 368/236 |

*Primary Examiner*—Vit W. Miska

*Attorney, Agent, or Firm*—Robert E. Burns; Emmanuel J. Lobato; Bruce L. Adams

[57] ABSTRACT

A calendar display wheel guard for a calendar timepiece, for rotatably mounting a calendar display wheel and for spacing a dial plate of the timepiece from the calendar display wheel. The calendar display wheel guard comprises a body having a bore opening at a pair of opposite ends thereof, a first end portion having a major surface defining a first end face of the wheel guard, and a second end portion for fastening the wheel guard to a back plate. An intermediate portion of the wheel guard, between the first and second end portions thereof, extends through a central opening of the calendar display wheel to mount the display wheel for rotation. The first end of portion of the wheel guard has the maximum diameter of the wheel guard, and the end face of the first end portion of the wheel guard abuts a dial plate of the calendar timepiece so that the first end portion of the wheel guard maintains the dial plate spaced from the calendar display wheel.

5 Claims, 6 Drawing Figures

CALENDAR DISPLAY WHEEL GUARD CONSTRUCTION OF TIMEPIECE

BACKGROUND OF THE INVENTION

The present invention relates to a calendar display wheel guard of a timepiece provided with a calendar display wheel.

The conventional construction of a calendar display wheel guard of a timepiece provided with a calendar is shown in FIGS. 1 and 2.

As shown in FIG. 1, an hour wheel 1 serves as a guide for a calendar display wheel 3. A step portion 1*a* is provided at an external periphery of the hour wheel 1, and a calendar display wheel guard 2 is fixed via the step portion 1*a* to thereby guard the calendar display wheel 3. As shown in FIG. 2, a calendar display wheel guide pin 5 is fixed to a back plate 4 as one body and the calendar display wheel 3 is guided by the calendar display wheel guide pin 5 and the calendar display wheel 3 is guarded by fixing the calendar display wheel guard 2.

However, by the method shown in FIG. 1, it is impossible to step with low torque since power from a calendar jumper 12 to position the calendar display wheel 3 is applied to the hour wheel 1 and the friction torque of the rear gear train increases. And as shown in FIG. 2, the construction to prevent an increase in the friction torque of the rear gear train necessitates the calendar display wheel guide pin 5 having a larger diameter than diameter 1*b* of the hour wheel 1, and a dial 6 provided with a hole 6*a* larger than an external diameter 5*a* of the calendar display wheel guide pin 5 becomes necessary and this imposes a large restriction on designing the timepiece. Further, when the dial 6 is positioned underlapping the calendar display wheel guide pin 5, gaps are between the calendar display wheel 3 and the dial 6, and consequently the thickness of the timepiece is hard to be reduce.

SUMMARY OF THE INVENTION

It is an object of the present invention to reduce the thickness of a timepiece as a whole and the number of the parts and to improve the processing efficiency of the parts. This is achieved with a calendar display wheel guard which directly engages with bridges, a back plate or the like. A calendar display wheel is mounted for rotation on the wheel guard, and the wheel guard maintains a dial plate spaced from the calendar display wheel.

DETAILED DESCRIPTION OF THE INVENTION

Hereafter the present invention will be described in conjunction with FIGS. 3 through 6.

Figure 4:
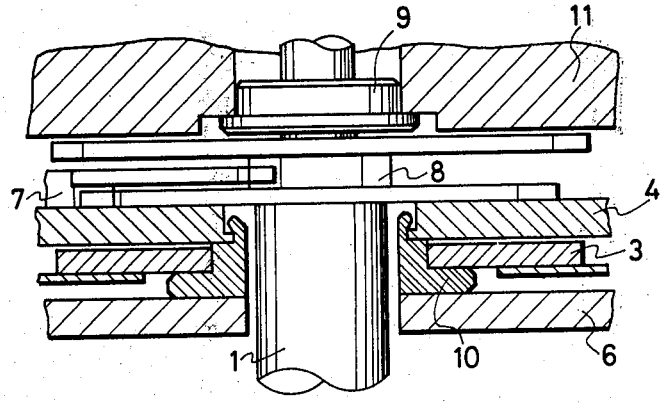

In the drawings numeral 1 is an hour wheel, numeral 2 is a calendar display wheel guard directly engaged with a back plate 4 and the wheel guard 2 determines the gap in the thrust direction of the calendar display wheel 3 and guards the calendar display wheel 3. While a calendar display wheel guard 10 shown in FIG. 4 is directly engaged with the back plate 4 and guides the rotation of the calendar display wheel 3 and determines the gap in the thrust direction thereof. Numeral 6 is a dial, numeral 7 is a minute wheel, numeral 8 is a center wheel and pinion, numeral 9 is a center axis and numeral 11 is a base plate.

Figure 5:
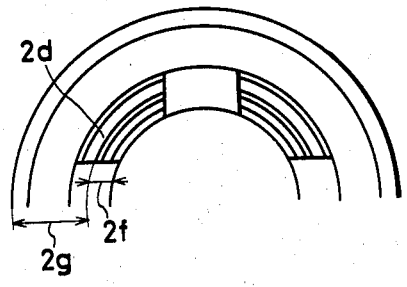
FIGS. 5 and 6 are a plan view and a sectional view showing examples of a calendar display wheel guard according to the present invention.
Figure 6:
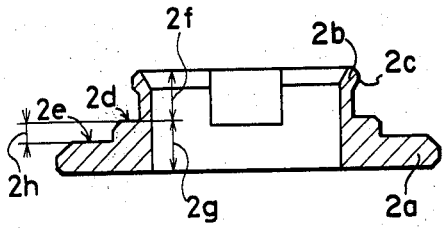

FIGS. 5 and 6 show examples of a calendar display wheel guard. In FIGS. 5 and 6, a surface 2*d* corresponds to a back plate and the like, and a gap in the thrust direction of the calendar display wheel 3 is provided by a distance 2*h* between surfaces 2*d* and 2*e*. 2*f* is a spring or resilient portion and 2*g* is a rigid portion.

Figure 1:
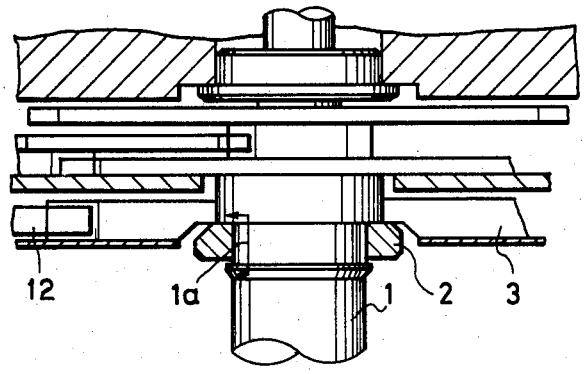
FIG. 1 PRIOR ART
FIGS. 1 and 2 are sectional views showing the conventional calendar display wheel guard construction.
Figure 2:
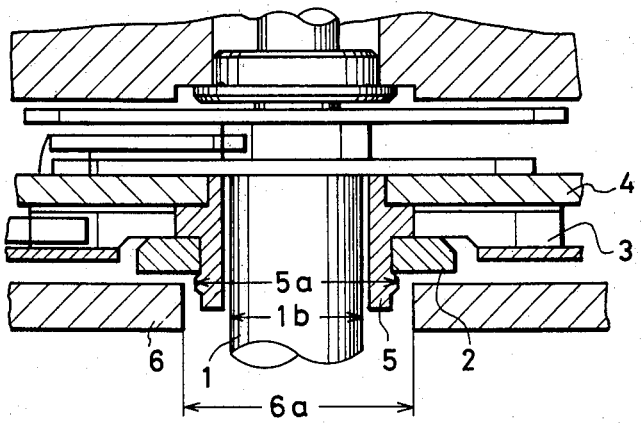
FIG. 2 PRIOR ART
Figure 3:
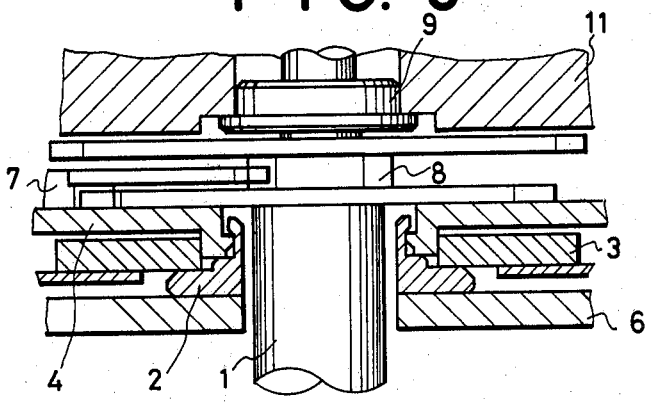
FIGS. 3 and 4 are sectional views showing embodiments of the calendar display wheel guard construction according to the present invention.

The calendar display wheel guard 2 constitutes calendar display wheel guard means for rotatably mounting the calendar display wheel 3 and for spacing the dial plate 6 from the calendar display wheel 3. A first end portion 2*a* of the wheel guard 2 has the greatest diameter of the wheel guard, and the first end portion 2*a* has a major surface which defines a first end surface of the wheel guard 2. A second end portion 2*b* of the wheel guard 2 has an outwardly protruding lip 2*c* at the second end of wheel guard 2 which is circumferential of the bore through the wheel guard. As shown in FIGS. 3 and 4, the outwardly protruding lip 2*c* constitutes means for fastening the second end portion of the wheel guard to the back plate 4 with the opening of the bore through the wheel guard aligned with respective central openings through the dial plate 6, calendar display wheel 3 and back plate 4.

An intermediate portion of the wheel guard 2, between the first and second end portions thereof, is dimensioned to pass through the central opening of the calendar display wheel 3 for mounting the calendar display wheel 3 for rotation. As shown in FIG. 3, back plate 4 has a step portion which extends into the central opening through the calendar display wheel 3. The step portion of the back plate 4 defines a bearing surface on which the calendar display wheel 3 is seated and on which it rotates. In the embodiment shown in FIG. 4 the intermediate portion of the wheel guard 10 defines a bearing surface, and the calendar display wheel 3 is directly seated on this bearing surface for rotation.

As illustrated, according to the present invention, useless gaps between the calendar display wheel 3 and the dial 6 is eliminated to thereby reduce the thickness of the timepiece as a whole. Additionally, the balance of the hole diameter of the dial and the hour wheel is made small, and thereby it is advantageous for designing the timepiece, decreasing the number of timepiece parts and processing the parts.

I claim:

1. In a calendar timepiece: a dial plate; a calendar display wheel; a back plate, wherein said dial plate, said calendar display wheel and said back plate each have a central opening therethrough and are positioned facing each other in the named order with their central openings aligned; and calendar display wheel guard means mounted on said back plate for rotatably mounting said calendar display wheel and for spacing said dial plate from said calendar display wheel, wherein said calendar display wheel guard means has a bore extending therethrough aligned with the respective central openings of said dial plate, said calendar display wheel, and said back plate, said calendar display wheel guard means has a first end face surrounding the opening of the bore at a first end of said calendar display wheel guard means, said first end face of said display wheel guard means abutting said dial plate for maintaining said dial plate spaced from said calendar display wheel, and no portion of said calendar display wheel guard means extends into the central opening through said dial plate.

2. In a calendar timepiece according to claim 1, wherein: said calendar display wheel guard means has a bore extending therethrough and opening at a pair of opposite ends of said calendar display wheel guard means; a first end portion of said calendar display wheel guard means surrounding the bore opening at the first end of said calendar display wheel guard means has the greatest diameter of any portion of said calendar display wheel guard means; a second end portion of said calendar display wheel guard means is dimensioned to be received in the central opening of said back plate and includes means for fastening said second end portion of said calendar display wheel guard means to said back plate with the bore through said calendar display wheel guard means aligned with the central opening through said back plate; and an intermediate portion between said first end portion and said second end portion of said calendar display wheel guard means fitting within the central opening of said calendar display wheel for rotatably mounting said calendar display wheel.

3. In a calendar timepiece; a dial plate; a calendar display wheel; a back plate, wherein said dial plate, said calendar display wheel and said back plate each have a central opening therethrough and are positioned facing each other in the named order with their central openings aligned; and a calendar display wheel guard mounted on said back plate for rotatably mounting said calendar display wheel and for spacing said dial plate from said calendar display wheel, said calendar display wheel guard comprising a body having a bore therethrough opening at a pair of opposite ends thereof, a first end portion of said calendar display wheel guard having a maximum diameter of said wheel guard and having a major surface defining a first end face of said wheel guard and a second surface opposite the first end face of said wheel guard, said wheel guard positioned with said first end face abutting said dial plate and the bore through said wheel guard aligned with the central opening through said dial plate and said calendar display wheel abutting the second surface of said first end portion of said wheel guard whereby said dial plate and said calendar display wheel are maintained spaced by said first end portion of said wheel guard, said calendar display wheel guard further comprising a second end portion having means for fastening said second end portion to said back plate by engaging said back plate with the opening of the bore through said wheel guard aligned with the central opening through said back plate, said wheel guard having an intermediate portion between said first and second end portions which extends through the central opening through said calendar display wheel, and said back plate has a step portion dimensioned to extend into the central opening through said calendar display wheel and over the intermediate portion of said wheel guard for defining a bearing surface with said calendar display wheel seated directly on said bearing surface for rotation.

4. In a calendar timepiece according to claim 3, said means for fastening comprising an outwardly protruding lip at the second end of said wheel guard and circumferential of the bore through said wheel guard and dimensioned for engaging an edge of said back plate defining the central opening through said back plate to fasten said wheel guard to said back plate with the bore through said wheel guard aligned with the central opening through said back plate.

5. In a calendar timepiece according to claim 4, wherein said second end portion of said wheel guard is resilient to permit said outwardly protruding lip to be inserted through the central opening through said back plate for fastening said wheel guard to said back plate.

* * * * *